US010041432B2

(12) United States Patent
Puckett et al.

(10) Patent No.: US 10,041,432 B2
(45) Date of Patent: Aug. 7, 2018

(54) FUEL SYSTEM HAVING PUMP PROGNOSTIC FUNCTIONALITY

(71) Applicant: Caterpillar Inc., Peoria, IL (US)

(72) Inventors: Daniel Reese Puckett, Peoria, IL (US); Bradley Scott Bashore, Washington, IL (US); Michael Edward Sattler, Galesburg, IL (US); Michael Scott Marchionda, Peoria, IL (US); Sasidhar Rayasam, Peoria, IL (US); Kranti Kumar Nellutla, Normal, IL (US)

(73) Assignee: Caterpillar Inc., Deerfield, IL (US)

( * ) Notice: Subject to any disclaimer, the term of this patent is extended or adjusted under 35 U.S.C. 154(b) by 38 days.

(21) Appl. No.: 15/401,911

(22) Filed: Jan. 9, 2017

(65) Prior Publication Data

US 2018/0195458 A1 Jul. 12, 2018

(51) Int. Cl.

| | |
|---|---|
| ***F02D 41/00*** | (2006.01) |
| ***F02D 41/30*** | (2006.01) |
| ***F02M 55/02*** | (2006.01) |
| ***F02M 63/02*** | (2006.01) |

(52) U.S. Cl.

CPC ..... *F02D 41/3082* (2013.01); *F02M 55/025* (2013.01); *F02M 63/0265* (2013.01); *F02M 2200/247* (2013.01)

(58) Field of Classification Search

CPC ..... F02D 41/3082; F02M 55/025; F02M 63/0265; F02M 2200/247

See application file for complete search history.

(56) References Cited

U.S. PATENT DOCUMENTS

| | | | | |
|---|---|---|---|---|
| 2,859,612 | A | 11/1958 | Morse | |
| 5,117,683 | A * | 6/1992 | Phillips | F02M 65/008 73/114.38 |
| 5,954,032 | A * | 9/1999 | Augustin | F02D 41/0087 123/198 DB |
| 5,974,865 | A | 11/1999 | Dambach | |
| 7,272,488 | B2 * | 9/2007 | Hayashi | F02M 25/0827 701/114 |
| 7,360,408 | B2 | 4/2008 | Dingler et al. | |

(Continued)

FOREIGN PATENT DOCUMENTS

| | | |
|---|---|---|
| DE | 102011102282 | 11/2012 |
| JP | 5217514 | 6/2013 |

*Primary Examiner* — Hieu T Vo
*Assistant Examiner* — Sherman Manley
(74) *Attorney, Agent, or Firm* — Finnegan, Henderson, Farabow, Garrett & Dunner, LLP

(57) ABSTRACT

A fuel system is disclosed for use with an engine. The fuel system may have a plurality of fuel injectors, a common rail fluidly, a pump, and an outlet valve associated with the pump. The fuel system may also have a sensor configured to generate a signal indicative of a pressure of fuel in the common rail, and an electronic control module. The electronic control module may be configured to detect a zero-fueling condition, to determine a first pressure decay rate of the common rail during the zero-fueling condition while the pump is rotating, and to determine a second pressure decay rate of the common rail during the zero-fueling condition after the pump has stopped rotating. The electronic control module may also be configured to selectively generate a diagnostic flag associated with wear of the outlet valve based on the first and second pressure decay rates.

20 Claims, 3 Drawing Sheets

(56) References Cited

U.S. PATENT DOCUMENTS

| | | | | |
|---|---|---|---|---|
| 7,392,792 | B2 * | 7/2008 | Puckett | F02D 41/22 123/198 D |
| 7,891,340 | B2 * | 2/2011 | Surnilla | F02D 41/062 123/179.17 |
| 7,938,101 | B2 * | 5/2011 | Cinpinski | F02D 41/2467 123/446 |
| 7,950,371 | B2 * | 5/2011 | Cinpinski | F02D 41/221 123/446 |
| 7,980,120 | B2 * | 7/2011 | Cinpinski | F02D 41/221 701/114 |
| 8,332,130 | B2 * | 12/2012 | Stretch | F02D 33/003 123/479 |
| 8,442,745 | B2 * | 5/2013 | Ando | F02D 41/3863 123/479 |
| 9,051,893 | B2 * | 6/2015 | Jung | F02D 41/221 |
| 2007/0079808 | A1 * | 4/2007 | Takahashi | F02D 41/221 123/447 |
| 2009/0260601 | A1 * | 10/2009 | Ulrey | F02B 1/12 123/512 |
| 2013/0013174 | A1 * | 1/2013 | Nistler | F02D 41/123 701/112 |
| 2013/0013175 | A1 * | 1/2013 | Nistler | F02D 41/22 701/112 |
| 2015/0300287 | A1 | 10/2015 | Ulrey et al. | |

* cited by examiner

FUEL SYSTEM HAVING PUMP PROGNOSTIC FUNCTIONALITY

TECHNICAL FIELD

The present disclosure is directed to a fuel system and, more particularly, to a fuel system having pump prognostic functionality.

BACKGROUND

Conventional fuel systems include a pump, one or more fuel injectors, and a distribution network for directing the pressurized fuel from the pump to the fuel injectors. Over time, the different components of the fuel system wear, causing efficiency losses and/or gradual deviations from desired operating pressures. If these losses and pressure deviations are left unchecked, the performance of the engine may deteriorate. In addition, if the wear is excessive or damage to a component of the system occurs, extreme system pressure drop and/or collateral damage may be possible, leaving the engine inoperable. When the engine becomes inoperable at a time that a host machine is away from a service area, repairs to the system may become time consuming, difficult, and costly. However, if the efficiency losses and pressure deviations can be monitored, corrective and/or precautionary actions may be timely implemented.

One example of a monitoring system is described in U.S. Patent Publication No. 2013/0013174 (the '174 publication) of Nistler et al. that published on Jan. 10, 2013. Specifically, the '174 publication discloses a method for monitoring operation an engine fuel system. The method includes stopping fuel injection during an engine coast-down event, closing an inlet metering valve of a pump, and monitoring a subsequent pressure decay rate of an associated common rail. When the pressure decay rate is greater than a decay threshold after a designated duration, the system presents a visual or audio indication of the condition to an operator.

Although the system of the '174 publication may be helpful in detecting some fuel system efficiency loss and/or pressure deviation, the system may provide limited benefit. In particular, some failure modes (e.g., when a pump outlet valve fails) can actually result in a lower-than normal pressure decay rate during a coast-down event. This type of failure mode may not be detectable via the system of the '174 publication. In addition, it may be helpful to know more information about a system inefficiency and/or pressure deviation beyond merely its existence.

The system of the present disclosure solves one or more of the problems set forth above and/or other problems of the prior art.

SUMMARY

One aspect of the present disclosure is directed to a fuel system. The fuel system may include a plurality of fuel injectors, a common rail fluidly connected to the plurality of fuel injectors, a pump configured to pressurize the common rail, and an outlet valve associated with the pump. The fuel system may also have a sensor configured to generate a signal indicative of a pressure of fuel in the common rail, and an electronic control module in communication with the sensor. The electronic control module may be configured to detect a zero-fueling condition, to determine a first pressure decay rate of the common rail during the zero-fueling condition while the pump is rotating, and to determine a second pressure decay rate of the common rail during the zero-fueling condition after the pump has stopped rotating. The electronic control module may also be configured to selectively generate a diagnostic flag associated with wear of the outlet valve based on the first and second pressure decay rates.

Another aspect of the present disclosure is directed to another fuel system. This fuel system may include a plurality of fuel injectors, a common rail fluidly connected to the plurality of fuel injectors, a pump configured to pressurize the common rail, and an outlet valve associated with the pump. The fuel system may also include a sensor configured to generate a signal indicative of a pressure of fuel in the common rail, and an electronic control module in communication with the sensor. The electronic control module may be configured to detect a zero-fueling condition, to determine a first pressure decay rate of the common rail during the zero-fueling condition while the pump is rotating, to determine a second pressure decay rate of the common rail during the zero-fueling condition after the pump has stopped rotating in association with a first pressure range, and to determine a third pressure decay rate of the common rail during the zero-fueling condition after the pump has stopped rotating in association with a second pressure range that is lower than the first pressure range. The electronic control module may also be configured to selectively generate an early-hour flag associated with wear of the outlet valve when a ratio of the third pressure decay rate to the second pressure decay rate is greater than a level-1 ratio, the third pressure decay rate is higher than a prognostic limit, and a ratio of the first pressure decay rate to the second pressure decay rate is less than a level-2 ratio. The electronic control module may be further configured to selectively generate a late-hour diagnostic flag associated with wear of the outlet valve when the ratio of the third pressure decay rate to the second pressure decay rate is greater than the level-1 ratio, the third pressure decay rate is higher than the prognostic limit, and the ratio of the first pressure decay rate to the second pressure decay rate is greater than the level-2 ratio.

Yet another aspect of the present disclosure is directed to a method of prognosticating a fuel system. The method may include detecting a zero-fueling condition, determining a first pressure decay rate of a common rail during the zero-fueling condition while an associated pump is rotating, and determining a second pressure decay rate of the common rail during the zero-fueling condition after the pump has stopped rotating. The method may also include selectively generating a diagnostic flag corresponding to wear of an outlet valve associated with the pump based on the first and second pressure decay rates.

DETAILED DESCRIPTION

Figure 1:
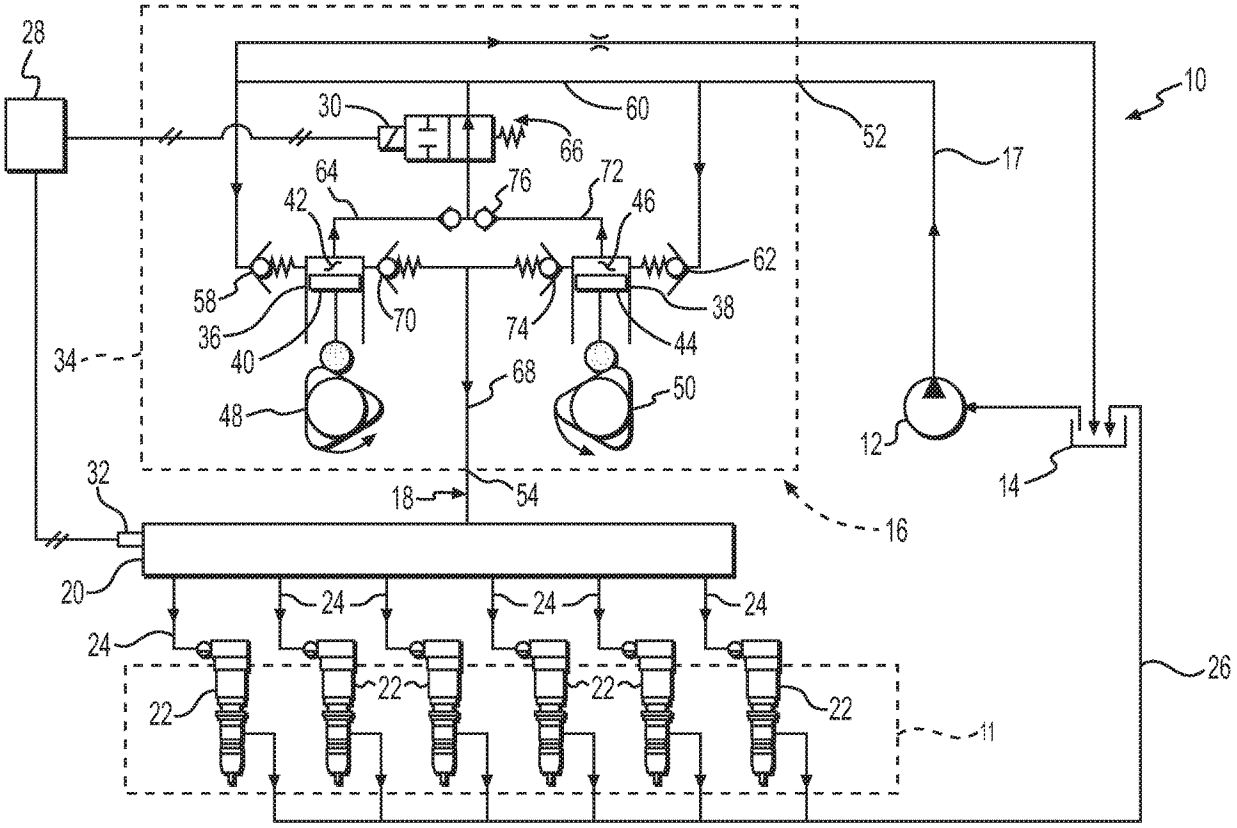
FIG. 1 is a diagrammatic illustration of an exemplary disclosed fuel system.

FIG. 1 illustrates an exemplary fuel system 10 for use with a combustion engine 11. Fuel system 10 may include, among other things a fuel transfer pump 12 that transfers fuel from a low-pressure reservoir 14 to a high-pressure pump 16 via a fluid passage 17. High-pressure pump 16 may pressurize the fuel and direct the pressurized fuel through a fluid passage 18 to a common rail 20, which is in further fluid communication with a plurality of fuel injectors 22 via individual fluid passages 24. Fuel injectors 22 may be fluidly connected to reservoir 14 via a return passage 26. An electronic control module (ECM) 28 may be in communication with a spill control valve 30, with a pressure sensor 32, and with each individual fuel injector 22. As will be described in more detail below, control signals may be generated by ECM 28 based on feedback from sensor 32 and directed to high-pressure pump 16 (e.g., to spill control valve 30) for use in regulating when and how much fuel is pumped into fuel rail 20. Similarly, control signals may be generated by ECM 28 that are directed to fuel injectors 22 and used to regulate the injection timing and duration of fuel injectors 22.

High-pressure pump 16 may include a housing 34 defining one or more (e.g., first and second) barrels 36, 38. High-pressure pump 16 may also include a first plunger 40 slidably disposed within first barrel 36. First barrel 36 and first plunger 40 together may define a first pumping chamber 42. High-pressure pump 16 may also include a second plunger 44 slidably disposed within second barrel 38. Second barrel 38 and second plunger 44 together may define a second pumping chamber 46.

First and second drivers 48, 50 may be operably connected to first and second plungers 40, 44, respectively. Drivers 48, 50 may each include means for driving first and second plungers 40, 44 such as, for example, a cam, a solenoid actuator, a piezo actuator, a hydraulic actuator, a motor, or any other driving means known in the art. A rotation of first driver 48 may result in a corresponding reciprocation of first plunger 40, while a rotation of second driver 50 may result in a corresponding reciprocation of second plunger 44. First and second drivers 48, 50 may be oriented relative to each other such that first and second plungers 40, 44 are caused to reciprocate out of phase with one another. First and second drivers 48, 50 may each include multiple (e.g., three) lobes such that one rotation of a pump shaft (not shown) connected to first and second drivers 48, 50 results in multiple (e.g., six) pumping strokes. It is contemplated that first and second drivers 48, 50 may include any number of lobes rotated at a rate synchronized to fuel injection activity.

High-pressure pump 16 may include an inlet 52 that fluidly connects high-pressure pump 16 to fluid passage 17, and a low-pressure gallery 60 in fluid communication with inlet 52 and in selective communication with first and second pumping chambers 42, 46. A first inlet check valve 58 may be disposed between low-pressure gallery 60 and first pumping chamber 42, and configured to allow a flow of low-pressure fluid from gallery 60 to first pumping chamber 42. A second inlet check valve 62 may be disposed between low-pressure gallery 60 and second pumping chamber 46, and configured to allow a flow of low-pressure fluid from gallery 60 to second pumping chamber 46.

High-pressure pump 16 may also include an outlet 54 that fluidly connects high-pressure pump 16 to fluid passage 18, and a high-pressure gallery 68 in selective fluid communication with first and second pumping chambers 42, 46 and outlet 54. A first outlet valve 70 may be disposed between first pumping chamber 42 and high-pressure gallery 68, and configured to allow a flow of fluid from first pumping chamber 42 to high-pressure gallery 68. A second outlet valve 74 may be disposed between second pumping chamber 46 and high-pressure gallery 68, and configured to allow a flow of fluid from second pumping chamber 46 to high-pressure gallery 68. It should be noted that a single outlet valve could be used to control all flows into high-pressure gallery 68, if desired.

High-pressure pump 16 may also include a first spill passage 64 selectively fluidly connecting first pumping chamber 42 to low-pressure gallery 60, and a second spill passage 72 selectively fluidly connecting second pumping chamber 46 to low-pressure gallery 60. Spill control valve 30 may be disposed between first and second pumping chambers 42, 46 and low-pressure gallery 60, and configured to selectively allow a flow of fluid from first and second spill passages 64, 72 to low-pressure gallery 60.

In the disclosed embodiment, only one of first and second pumping chambers 42, 46 may be fluidly connected to low-pressure gallery 60 at a time. That is, the fluid connection between pumping chambers 42, 46 and low-pressure gallery 60 may be established by a shuttle valve 76. Because first and second plungers 40, 44 may move out of phase relative to one another, one pumping chamber may be at high-pressure (pumping stroke) when the other pumping chamber is at low-pressure (intake stroke), and vice versa. This action may be exploited to move shuttle valve 76 back and forth to fluidly connect either first spill passage 64 to spill control valve 30, or second spill passage 72 to spill control valve 30. Thus, first and second pumping chambers 42, 46 share a common spill control valve 30. It is contemplated, however, that separate spill control valves 30 could be associated with each pumping chamber, if desired.

ECM 28 may include all the components required to regulate operation of fuel system 10 such as, for example, a memory, a secondary storage device, and a processor, such as a central processing unit. One skilled in the art will appreciate that ECM 28 can contain additional or different components. Associated with ECM 28 may be various other known circuits such as, for example, power supply circuitry, signal conditioning circuitry, and solenoid driver circuitry, among others.

During control of fuel system 10, ECM 28 may rely on signals generated by pressure sensor 32 (in addition to other conventional engine signals). Pressure sensor 32 may be configured to continuously generate signals indicative of the pressure of fuel inside of common rail 32, and to direct these signals to ECM 28. It should be noted that, although a single pressure sensor 32 is shown as being located with an end of common rail 20, it is contemplated that any number of pressure sensors may be located anywhere within fuel system 10 (e.g., in communication with passage 18, anywhere along common rail 20, in passage 24, at outlet 54, in passage 68, in chambers 42 and/or 46, etc.). It is also contemplated that sensor 32 may alternatively sense a different or additional parameter of the fuel associated with common rail 20 such as, for example, a temperature, a viscosity, a flow rate, or another parameter known in the art.

ECM 28 may be configured to selectively adjust the operation of high-pressure pump 16 in response to the signals received from pressure sensor 32. That is, when the pressure of the fuel within common rail 20 falls below a desired value, ECM 28 may adjust the operation of high-pressure pump 16 to increase the pressure within common rail 20. The pressure within common rail 20 may be increased, for example, by reducing an amount of fuel spilled per plunger stroke (e.g., by maintaining spill control valve 30 in a closed position for a greater period of time). In contrast, when the pressure of the fuel within common rail 20 rises above the desired value, ECM 28 may cause spill control valve 30 to remain open for a longer period of time. In some situations (e.g., during a prognostic event), ECM 28 may also be configured to adjust operation of one or more of fuel injectors 22 (e.g., to cause fuel injectors 22 to inject and/or bypass a greater amount of fuel) and thereby selectively lower a pressure within common rail 20.

Figure 2:
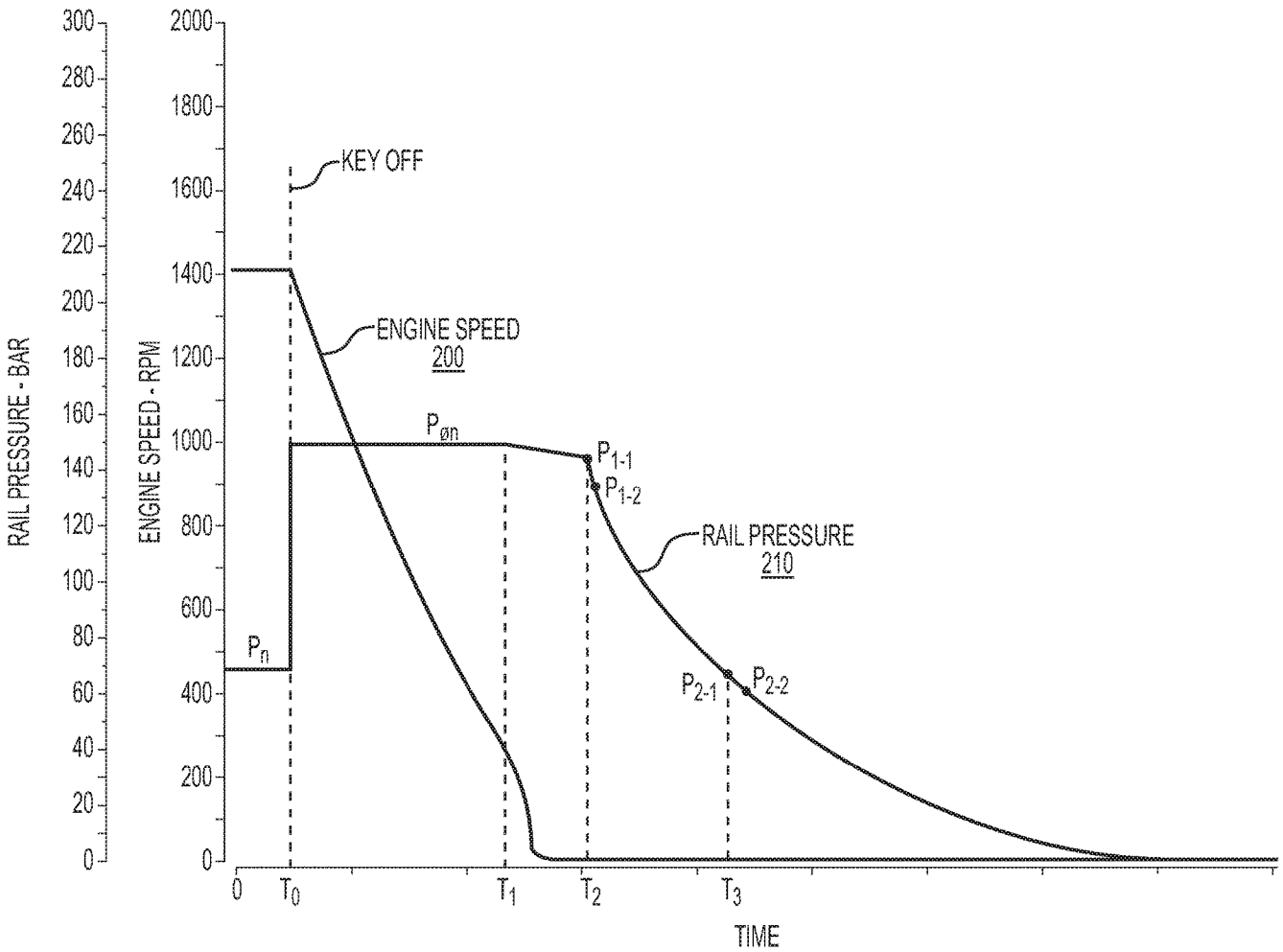
FIG. 2 is a trace chart showing results of an exemplary method implemented by the fuel system of FIG. 1.
Figure 3:
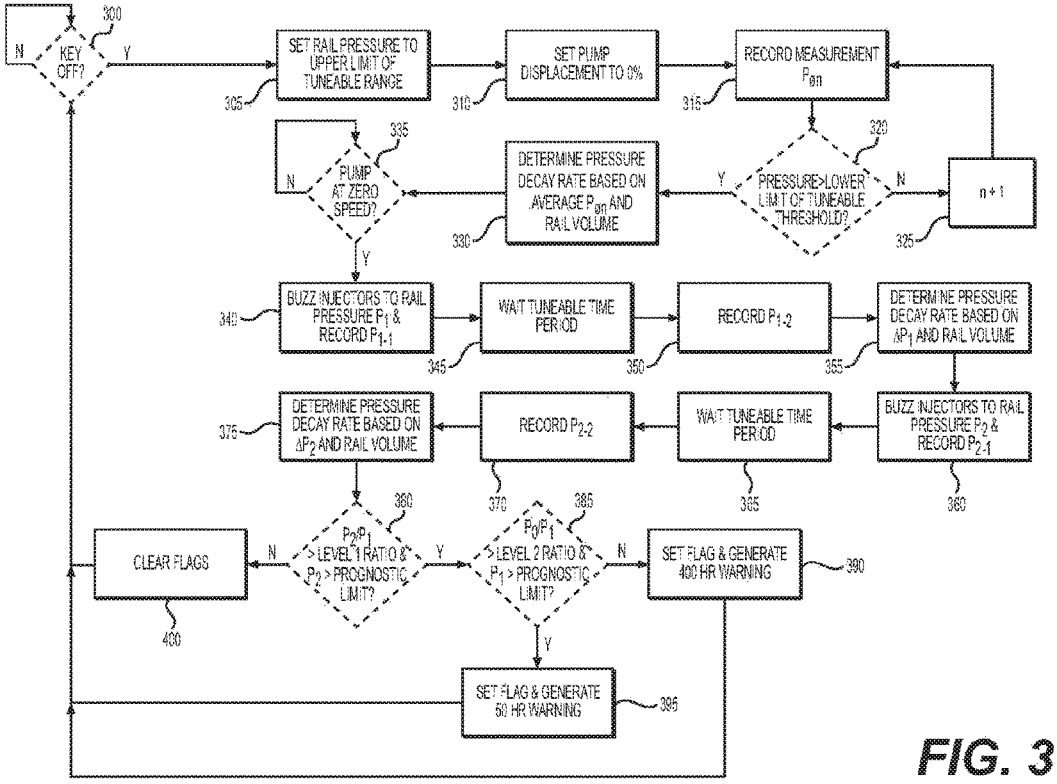
FIG. 3 is a flow chart depicting the exemplary method implemented by the fuel system of FIG. 1.

FIG. 2 illustrates a graph depicting an exemplary operation of fuel system 10. The graph includes a first trace 200 representative of a speed of engine 11 driving high-pressure pump 16 (e.g., as provided by an existing engine speed sensor—not shown) relative to time, while a second trace 210 represents a pressure of common rail 20 (e.g., as provided by sensor 32) relative to time. As shown by first and second traces 200, 210, during normal operation (i.e., when engine 11 is operating at about 1400 rpm), high-pressure pump 16 may be controlled (e.g., via operation of spill control valve 30) to pressurize common rail 20 to a first or normal pressure level (e.g., to about 450 bar) $P_n$. At a time $T_0$, when shutdown of engine 11 has been requested (e.g., when a key of engine 11 has been manually turned off) and/or commanded (e.g., automatically by an autonomous vehicle controller—not shown), ECM 28 may initiate a prognostic routine. This routine is depicted in first and second traces 200, 210 of FIG. 2, as well as in the flowchart of FIG. 3. FIGS. 2 and 3 will be described in more detail to further illustrate the disclosed system and its operation.

INDUSTRIAL APPLICABILITY

The fuel system of the present disclosure has wide application in a variety of engine types including, for example, diesel engines, gasoline engines, and gaseous fuel-powered engines. The disclosed fuel system may be implemented into any engine where continuous health monitoring (e.g., pump health monitoring and/or leak detection) is important, without causing interruption of normal engine operation. Operation of fuel system 10 will now be described.

ECM 28 may initiate the prognostic method of FIG. 3 every time that a zero-fueling condition exists. Such a condition may include any situation where essentially no fuel is being injected by injectors 22, for example, when the host machine is coasting or when engine 11 is being shut down. In the disclosed example, ECM 28 determines a zero fueling condition by monitoring when a key (not shown) of the host machine has been manually turned to an off-position (Step 300). It is contemplated, however, that ECM 28 may determine existence of the zero-fueling condition based instead off of a current directed to fuel injectors 22, a current directed to high-pressure pump 16, a position of an acceleration or deceleration pedal (not shown), a pressure of fuel system 10, and/or in any other manner apparent to one skilled in the art.

As long as ECM 28 determines at step 300 that engine 11 is currently being fueled (i.e., that the zero-fueling condition is nonexistent—step 300: N), control of fuel system 10 may continue normally (i.e., control may cycle through step 300). For example, a parameter indicative of the pressure within common rail 20 may be monitored via sensor 32, quantified, and compared to a desired and expected common rail pressure range. This desired and expected common rail pressure range may correspond with a pressure of fuel within common rail 20 required for proper operation of fuel injectors 22 and that results in a desired engine output (e.g., speed and/or torque). Based on the comparison, ECM 28 may selectively control movement of spill control valve 30 and/or operation of injectors 22 to raise or lower the fuel pressure inside of common rail 20.

Once ECM 28 determines that the zero-fueling condition exists (step 300: Y), ECM 28 may set the fuel pressure of common rail 20 to the upper limit of a tuneable prognostic range $P_0$ (step 305). As can be seen in trace 210 of FIG. 2, the upper limit of the prognostic range $P_0$ may be higher than the normal pressure $P_n$ of common rail 20. In the disclosed example of FIG. 2, the upper limit of the prognostic range $P_0$ is about 2-2.5 times $P_n$. ECM 28 may raise the pressure of common rail 20 from $P_n$ to the upper limit of the prognostic range $P_0$ by, for example, causing spill control valve 30 to remain closed for a longer period of time during each pumping stroke of high-pressure pump 16. This may increase the effective displacement of high-pressure pump 16 and thereby cause high-pressure pump 16 to supply pressurized fuel into common rail 20 at a greater rate, at a time when injectors 22 are injecting less (if any) fuel.

After completion of step 305, ECM 28 may reduce the effective displacement of high-pressure pump 16 to about 0% (step 310), and then record the pressure of the fuel inside of common rail 20 (step 315). ECM 28 may repetitively to do this until the pressure of the fuel inside common rail 20 falls to a lower limit of the tuneable pressure range $P_0$. That is, as long as a comparison performed at a step 320 indicates that the pressure measured at step 315 is not lower than the lower limit of the pressure range $P_0$, ECM 28 may increase a counter (n+1—step 325), and control may return to step 315 to record another pressure measurement. Once the comparison of step 320 indicates that the pressure measured at step 315 is lower than the lower limit of the pressure range $P_0$, ECM 28 may then determine a decay rate for the pressure range $P_0$ based on an average of the different recorded pressures and a known volume of common rail 20 (step 330). Steps 300-330 may all occur before high-pressure pump 16 has completely stopped rotating (i.e., before drivers 48 and 50 reach about zero rpm) during engine shutdown. High-pressure pump 16 may stop rotating at a time $T_1$ shown in FIG. 2, before engine (e.g., before an engine crankshaft—not shown) 11 has stopped rotating.

Once high-pressure pump 16 stops rotating (i.e., after time $T_1$), the pressure of the fuel inside of common rail 20 may decay at a greater rate. Accordingly, ECM 28 may determine when high-pressure pump 16 has stopped rotating (step 335), and then set the pressure of common rail 20 to the upper limit of another prognostic range $P_1$ and record a measurement of the pressure ($P_{1-1}$; step 340). ECM 28 may determine when high-pressure pump 16 has stopped rotating in any number of different ways. For example, ECM 28 may make this determination based on a sudden change in the pressure decay rate of common rail 20 (e.g., as detected via sensor 32). Alternatively, ECM 28 may determine that high-pressure pump 16 has stopped rotating based on a speed of engine 11 and a known engine/pump speed relationship. In yet another embodiment, ECM 28 may determine that high-pressure pump 16 has stopped rotating based on a speed of pump 16 that is directly measured via an additional speed sensor (not shown). It is contemplated that this determination could be made in other ways, if desired. The pressure of common rail 20 may be set to the upper limit of prognostic range $P_1$ at a time $T_2$ by, for example, selectively "buzzing" injectors 22. Buzzing injectors 22 may include selectively opening and closing injectors 22 to either inject or return fuel received from common rail 20 into combustion chambers of engine 11 or back to low-pressure reservoir 14. By consuming fuel from common rail 20 at a time when fuel is not being supplied to common rail 20, the pressure within common rail 20 will be caused to drop during completion of step 340.

After ECM 28 records pressure measurement $P_{1-1}$, ECM 28 may be configured to wait a tuneable time period (step 345), and then record another pressure measurement $P_{1-2}$ (Step 350). ECM 28 may then determine a pressure decay rate for the prognostic range $P_1$ based on $\Delta P_1$ and the known volume of common rail 20 (step 355).

After completion of step 355, ECM 28 may again set the pressure of common rail 20 to the upper limit of yet another prognostic range $P_2$, and record a measurement of the pressure ($P_{2-1}$; step 360) at a time $T_3$. The pressure of common rail 20 may be set to the upper limit of the prognostic range $P_2$ in the same manner described above (e.g., by buzzing injectors 22), in regard to step 340. Thereafter, ECM 28 may wait another tuneable time period (step 365), and then record another pressure measurement $P_{2-2}$ (step 370). ECM 28 may then determine a pressure decay rate for the prognostic range $P_2$ based on $\Delta P_2$ and the known volume of common rail 20 (Step 375).

ECM 28 may be configured to then determine a health (e.g., predict a remaining useful life) of high-pressure pump 16 based on the pressure decay rates $P_0$, $P_1$, and $P_2$. In particular, ECM 28 may compare a ratio of $P_2/P_1$ to a level-1 ratio, and $P_2$ to a prognostic limit (step 380). When the ratio of $P_2/P_1$ is greater than the level-1 ratio and $P_2$ is greater than the prognostic limit (step 380: Y), ECM 28 may then compare a ratio of $P_0/P_1$ to a level-2 ratio, and $P_1$ to a prognostic limit (step 385). When the ratio of $P_0/P_1$ is less than the level-2 ratio and/or $P_1$ is less than the prognostic limit, ECM 28 may set an internal diagnostic flag and also generate an early-hour warning indicating that high-pressure pump 16 (i.e., that outlet valve 70 and/or 74 of pump 16) is reaching a wear threshold that requires servicing (Step 390). In one example, the early-hour warning may be associated with about 400 hrs. until failure. However, when the ratio of $P_0/P_1$ is greater than the level-2 ratio and $P_1$ is greater than the prognostic limit, ECM 28 may set an internal diagnostic flag and also generate a late-hour warning indicating that high-pressure pump 16 is at the threshold that requires servicing (Step 395). In one example, the late-hour warning may be associated with about 50 hrs. until failure. The relationships between the above-described ratios and the hours until failure of high-pressure pump 16 may be determined based on empirical data. Returning to step 380, when the ratio of $P_2/P_1$ is less than the level-1 ratio or $P_2$ is less than the prognostic limit, all previously set diagnostic flags may be cleared. Control may return from steps 390, 395, and 400 to step 300.

Fuel system 10 may provide improved prognostic functionality. In particular, because fuel system 10 may check for pump leakage (i.e., leakage at outlet valve 70 and/or 74) every time engine 11 experiences a zero-fueling condition, the health of high-pressure pump 16 may be continuously determined and immediately accommodated. In addition, fuel system 10 may perform this function without causing significant interruption of engine operation. Further, because ECM 28 may provide both an early-hour warning and a late-hour warning, the owner/operator of engine 11 may have flexibility regarding where and when to make any necessary repairs. Further, the disclosed warnings may allow for parts to be ordered and/or for the service to be scheduled in advance of their need. This may help to reduce downtime caused by the service.

It will be apparent to those skilled in the art that various modifications and variations can be made to the fuel system of the present disclosure without departing from the scope of the disclosure. Other embodiments will be apparent to those skilled in the art from consideration of the specification and practice of the fuel system disclosed herein. It is intended that the specification and examples be considered as exemplary only, with a true scope of the disclosure being indicated by the following claims and their equivalents.

What is claimed is:

1. A fuel system for an engine, comprising:
- a plurality of fuel injectors;
- a common rail fluidly connected to the plurality of fuel injectors;
- a pump configured to pressurize the common rail;
- an outlet valve associated with the pump;
- a sensor configured to generate a signal indicative of a pressure of fuel in the common rail; and
- an electronic control module in communication with the sensor and configured to:
  - detect a zero-fueling condition;
  - determine a first pressure decay rate of the common rail during the zero-fueling condition while the pump is rotating;
  - determine a second pressure decay rate of the common rail during the zero-fueling condition after the pump has stopped rotating; and
  - selectively generate a diagnostic flag associated with wear of the outlet valve based on the first and second pressure decay rates.

2. The fuel system of claim 1, wherein the electronic control module is further configured to:
- determine a third pressure decay rate of the common rail during the zero-fueling condition after the pump has stopped rotating; and
- selectively generate the diagnostic flag associated with wear of the outlet valve based on the first, second, and third pressure decay rates.

3. The fuel system of claim 2, wherein the electronic control module is configured to selectively generate:
- a first diagnostic flag associated with an early-hour warning; and
- a second diagnostic flag associated with a late-hour warning.

4. The fuel system of claim 3, wherein:
- the early-hour warning is associated with about 400 hrs. until failure of the pump; and
- the late-hour warning is associated with about 50 hrs. until failure of the pump.

5. The fuel system of claim 3, wherein:
- the first pressure decay rate is associated with a pressure range that is higher than pressure ranges associated with the second and third pressure decay rates; and
- the pressure range associated with the second pressure decay rate is higher than the pressure range associated with the third pressure decay rate.

6. The fuel system of claim 5, wherein the electronic control module is configured to generate the first diagnostic flag when a ratio of the third pressure decay rate to the second pressure decay rate is greater than a level-1 ratio, the third pressure decay rate is higher than a prognostic limit, and a ratio of the first pressure decay rate to the second pressure decay rate is less than a level-2 ratio.

7. The fuel system of claim 6, wherein the electronic control module is configured to generate the second diagnostic flag when the ratio of the third pressure decay rate to the second pressure decay rate is greater than the level-1 ratio, the third pressure decay rate is higher than the prognostic limit, and the ratio of the first pressure decay rate to the second pressure decay rate is greater than the level-2 ratio.

8. The fuel system of claim 5, wherein the first pressure decay rate is associated with a pressure range that is about 2 to 2.5 times a normal operating pressure.

9. The fuel system of claim 5, wherein the electronic control module is configured to cause the pump to raise the pressure of the common rail to a first range prior to determining the first pressure decay rate.

10. The fuel system of claim 9, wherein the electronic control module is configured to buzz the injectors to lower the pressure of the common rail prior to determining the second pressure decay rate and again prior to determining the third pressure decay rate.

11. The fuel system of claim 9, wherein the electronic control module is configured to determine the first pressure decay rate based on an average of multiple pressure measurements taken while the pump is still rotating during the zero-fueling condition.

12. The fuel system of claim 11, wherein the electronic control module is configured to determine each of the second and third pressure decay rates based on two pressure measurements spaced apart from each other by a tuneable time period.

13. A fuel system, comprising:

a plurality of fuel injectors;

a common rail fluidly connected to the plurality of fuel injectors;

a pump configured to pressurize the common rail;

an outlet valve associated with the pump;

a sensor configured to generate a signal indicative of a pressure of fuel in the common rail; and an electronic control module in communication with the sensor and configured to:

detect a zero-fueling condition;

determine a first pressure decay rate of the common rail during the zero-fueling condition while the pump is rotating;

determine a second pressure decay rate of the common rail during the zero-fueling condition after the pump has stopped rotating in association with a first pressure range;

determine a third pressure decay rate of the common rail during the zero-fueling condition after the pump has stopped rotating in association with a second pressure range that is lower than the first; and selectively generate:

an early-hour flag associated with wear of the outlet valve when a ratio of the third pressure decay rate to the second pressure decay rate is greater than a level-1 ratio, the third pressure decay rate is higher than a prognostic limit, and a ratio of the first pressure decay rate to the second pressure decay rate is less than a level-2 ratio; and a late-hour diagnostic flag associated with wear of the outlet valve when the ratio of the third pressure decay rate to the second pressure decay rate is greater than the level-1 ratio, the third pressure decay rate is higher than the prognostic limit, and the ratio of the first pressure decay rate to the second pressure decay rate is greater than the level-2 ratio.

14. A method of prognosticating health of a fuel system, the method comprising:

detecting a zero-fueling condition;

determining a first pressure decay rate of a common rail during the zero-fueling condition while an associated pump is rotating;

determining a second pressure decay rate of the common rail during the zero-fueling condition after the pump has stopped rotating; and selectively generating a diagnostic flag corresponding to wear of an outlet valve associated with the pump based on the first and second pressure decay rates.

15. The method of claim 14, further including determining a third pressure decay rate of the common rail during the zero-fueling condition after the pump has stopped rotating, wherein selectively generating the diagnostic flag includes selectively generating the diagnostic flag based on the first, second, and third pressure decay rates.

16. The method of claim 15, wherein selectively generating the diagnostic flag includes generating:

a first diagnostic flag associated with an early-hour warning; and a second diagnostic flag associated with a late-hour warning.

17. The method of claim 16, wherein:

the early-hour warning is associated with about 400 hrs. until failure of the pump; and the late-hour warning is associated with about 50 hrs. until failure of the pump.

18. The method of claim 17, wherein:

the first pressure decay rate is associated with a pressure range that is higher than pressure ranges associated with the second and third pressure decay rates; and the pressure range associated with the second pressure decay rate is higher than the pressure range associated with the third pressure decay rate.

19. The method of claim 18, wherein generating the first diagnostic flag includes generating the first diagnostic flag when a ratio of the third pressure decay rate to the second pressure decay rate is greater than a level-1 ratio, the third pressure decay rate is higher than a prognostic limit, and a ratio of the first pressure decay rate to the second pressure decay rate is less than a level-2 ratio.

20. The method of claim 19, wherein generating the second diagnostic flag includes generating the second diagnostic flag when the ratio of the third pressure decay rate to the second pressure decay rate is greater than the level-1 ratio, the third pressure decay rate is higher than the prognostic limit, and the ratio of the first pressure decay rate to the second pressure decay rate is greater than the level-2 ratio.

* * * * *